US006561264B2

(12) United States Patent
Ozaki et al.

(10) Patent No.: US 6,561,264 B2
(45) Date of Patent: May 13, 2003

(54) COMPOUND HEAT EXHANGER HAVING COOLING FINS INTRODUCING DIFFERENT HEAT EXHANGING PERFORMANCES WITHIN HEAT EXCHANGING CORE PORTION

(75) Inventors: Tatsuo Ozaki, Kariya (JP); Hiroshi Kokubunji, Kariya (JP)

(73) Assignee: Denso Corporation, Kariya (JP)

( * ) Notice: Subject to any disclaimer, the term of this patent is extended or adjusted under 35 U.S.C. 154(b) by 142 days.

(21) Appl. No.: 09/809,360

(22) Filed: Mar. 15, 2001

(65) Prior Publication Data

US 2001/0022220 A1 Sep. 20, 2001

(30) Foreign Application Priority Data

Mar. 16, 2000 (JP) ..... 2000-079350

(51) Int. Cl.[7] ..... F28D 7/10
(52) U.S. Cl. ..... 165/140; 165/135; 165/176
(58) Field of Search ..... 165/140, 176, 165/135

(56) References Cited

U.S. PATENT DOCUMENTS 4,063,431 A * 12/1977 Dankowski ..... 165/140
5,033,540 A * 7/1991 Tategami et al. ..... 165/135
5,046,554 A * 9/1991 Iwasaki et al. ..... 165/140
5,176,200 A * 1/1993 Shinmura ..... 165/140
5,366,005 A * 11/1994 Kadle ..... 165/140
5,566,748 A * 10/1996 Christensen ..... 165/140
5,992,514 A * 11/1999 Sugimoto et al. ..... 165/135
6,170,565 B1 1/2001 Nishishita
6,173,766 B1 * 1/2001 Nakamura et al. ..... 165/140
6,209,628 B1 * 4/2001 Sugimoto et al. ..... 165/140
6,305,465 B1 * 10/2001 Uchikawa et al. ..... 165/135
6,357,518 B1 * 3/2002 Sugimoto et al. ..... 165/140

FOREIGN PATENT DOCUMENTS

EP 0 866 298 A2 9/1998

* cited by examiner

*Primary Examiner*—Henry Bennett
*Assistant Examiner*—Terrell McKinnon
(74) *Attorney, Agent, or Firm*—Harness, Dickey & Pierce, PLC

(57) ABSTRACT

A condenser core portion carries out a heat exchange between refrigerant and air. The condenser core portion includes a plurality of condenser tubes through which the refrigerant flows and condenser fins disposed between each pair of adjacent condenser tubes. A radiator core portion is disposed in series with the condenser core portion in an external fluid flow direction with a predetermined clearance therebetween, to carry out a heat exchange between engine coolant and the air. The radiator core portion includes a plurality of radiator tubes through which the engine coolant flows and radiator fins disposed between each pair of adjacent radiator tubes. A connecting portion integrates each of condenser fins and radiator fins. The condenser fins disposed at an upper area of the condenser core portion introduce cooling performances more than the condenser fins disposed at a lower area thereof.

13 Claims, 9 Drawing Sheets

COMPOUND HEAT EXHANGER HAVING COOLING FINS INTRODUCING DIFFERENT HEAT EXHANGING PERFORMANCES WITHIN HEAT EXCHANGING CORE PORTION

CROSS REFERENCE TO RELATED APPLICATION

This application is based on and incorporates herein by reference Japanese Patent Application Nos. 2000-79350 filed on Mar. 16, 2000, and 2001-67002 filed on Mar. 9, 2001.

BACKGROUND OF THE INVENTION

1. Field of the Invention

The present invention relates to a compound heat exchanger including a plurality of heat exchangers suitable for use in an automotive cooling module in which a condenser is integrated with a radiator.

2. Description of Related Art

JP-A-10-253276 discloses a compound heat exchanger in which a condenser is integrated with a radiator. In the conventional compound heat exchanger, fin of a condenser core portion and fin of a radiator core portion are integrally formed, and a louver arrangement of the condenser fin is different from a louver arrangement of the radiator fin for adjusting heat exchanging performances of the radiator and the condenser.

Here, the louver arrangement includes etching angle, louver etching length, width dimension, the number of louvers, and the like.

However, in the conventional compound heat exchanger, heat exchanging performance does not vary within the condenser or within the radiator. Thus, when required heat exchanging performances are different between at one area and another area within the condenser or within the radiator, the conventional compound heat exchanger cannot satisfy such a request.

SUMMARY OF THE INVENTION

An object of the present invention is to provide a compound heat exchanger easily attaining required heat exchanging performance between at one area and another area within a heat-exchanging core.

According to the present invention, a first core portion to carries out a heat exchange between a first fluid and an external fluid. The first core portion includes a plurality of first tubes through which the first fluid flows and first cooling fins disposed between each pair of adjacent first tubes. A second core portion is disposed in series with the first core portion in an external fluid flow direction with a predetermined clearance therebetween, to carry out a heat exchange between a second fluid and the external fluid. The second core portion includes a plurality of second tubes through which the second fluid flows and second cooling fins disposed between each pair of adjacent second tubes. A connecting portion integrates each of first cooling fins and second cooling fins. At least one of the first cooling fins and the second cooling fins introduce different cooling performances between at one area and another area within at least one of the first core portion and the second core portion. Thus, the compound heat exchanger easily attains the required heat exchanging performance being different between at one area and another area within at least one of the first core portion and the second core portion.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

First Embodiment

Figure 1:
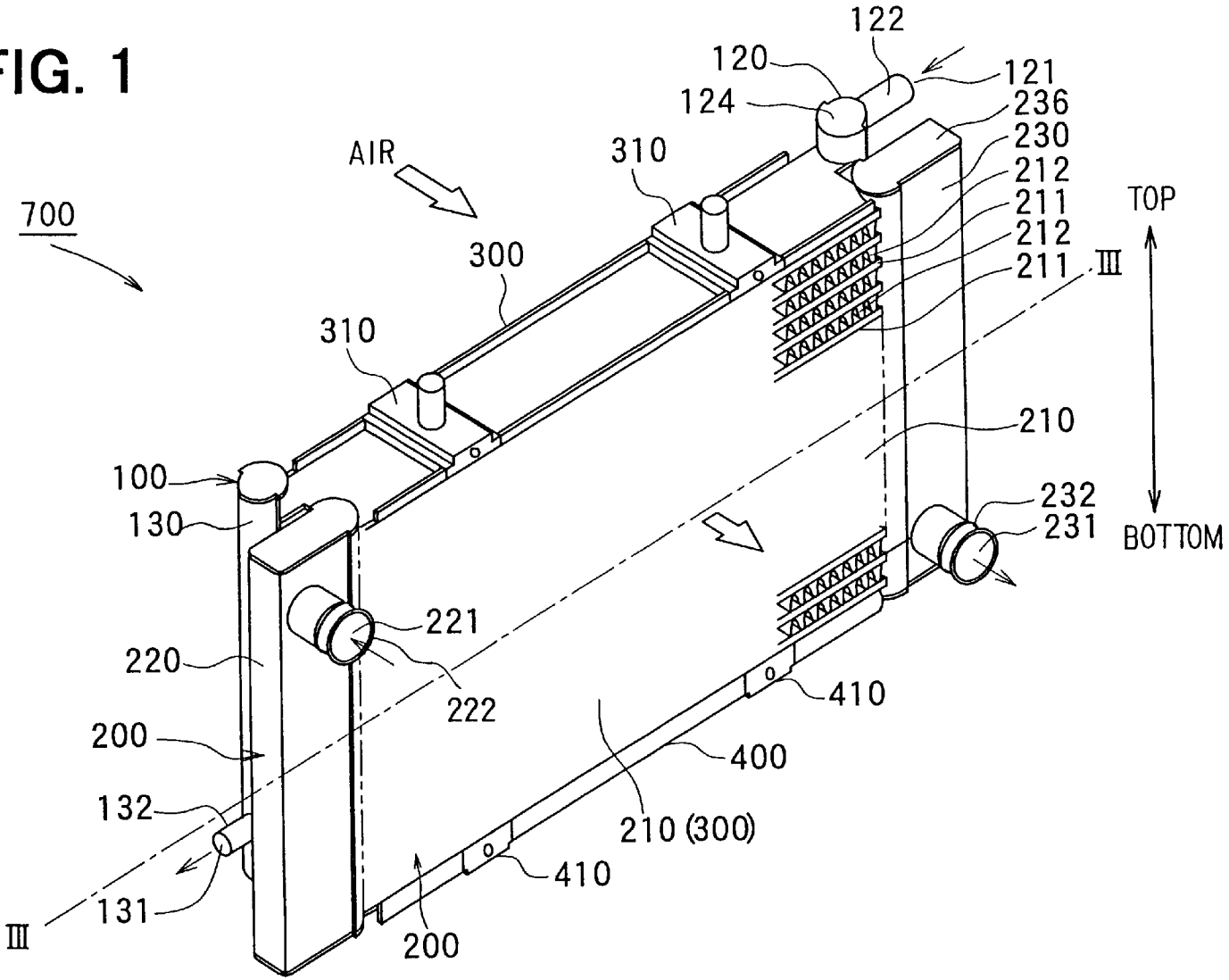
FIG. 1 is a perspective view showing a compound heat exchanger viewing from a radiator side (first embodiment)
Figure 2:
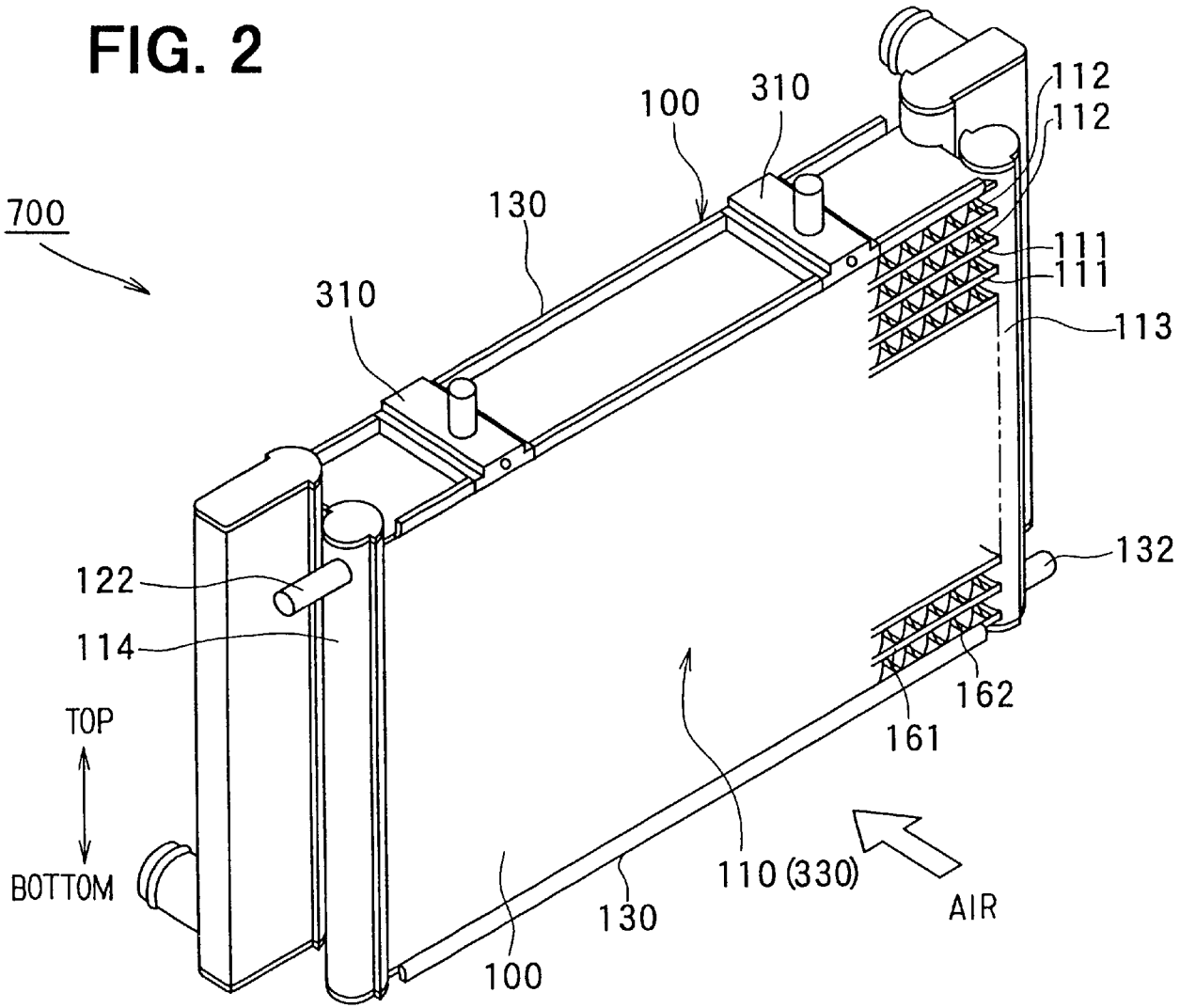
FIG. 2 is a perspective view showing the compound heat exchanger viewing from a condenser side (first embodiment)

As shown in FIGS. 1 and 2, a heat exchanger 700 includes a condenser 100 and a radiator 200. The condenser 100 cools a refrigerant (first fluid) circulating in a vehicle refrigerating cycle, and the radiator 200 cools an engine coolant (second fluid). In the heat exchanger 700, the condenser 100 and the radiator 200 are integrated with each other.

FIG. 1 is a perspective view showing the heat exchanger 700 viewing from the radiator 200 side (downstream side of air flow), and FIG. 2 is a perspective view showing the heat exchanger 700 viewing from the condenser 100 side (upstream side of air flow).

As shown in FIG. 2, the condenser 100 includes a condenser core portion (first core portion) 110. In the condenser core portion 110, condenser tubes 111 and corrugate fins 112 are provided. The condenser tube 111 is made of aluminum and formed in a flat. The condenser tube 111 has a refrigerant passage therein. The fin 112 is formed in a wave, and brazed to the condenser tube 111.

As shown in FIG. 1, the radiator 200 includes a radiator core portion (second core portion) 210. In the radiator core portion 210, radiator tubes 211 and corrugate fins 212 are provided. The radiator tube 211 is made of aluminum and formed in a flat. The radiator tube 111 has an engine coolant passage therein. The fin 212 is formed in a wave, and brazed to the radiator tube 211. The condenser tube 111 and the radiator tube 211 are arranged perpendicularly to the air flow, and arranged in parallel with each other.

In both core portions 110, 210, as shown in FIG. 3, a predetermined gap δ is provided between the condenser tube 111 and the radiator tube 211 for preventing the heat of the radiator core portion 210 from being transmitted to the condenser core portion 110.

Figure 4:
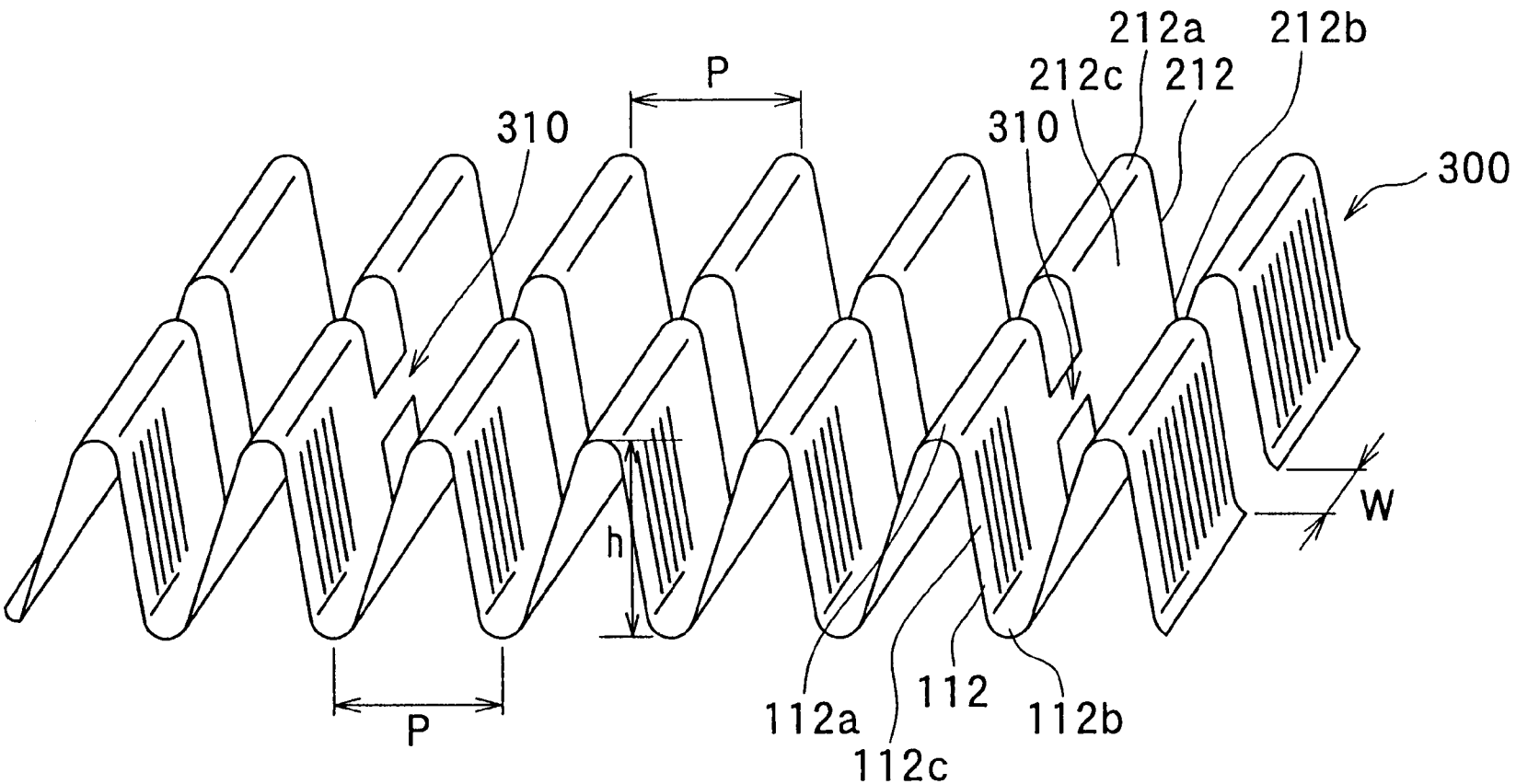
FIG. 4 is a perspective view showing an integrated fin (first embodiment)

The fins 112 and 212 are integrally roller-formed, and as shown in FIG. 4, include a plurality of peaks 112*a*, 212*a*, a plurality of valleys 112*b*, 212*b*, and a plurality of flat portions 112*c*, 212*c*. The flat portions 112*c*, 212*c* are formed between the peaks 112*a*, 212*a* and valleys 112*c*, 212*c* adjacent thereto.

Hereinafter, the fins 112, 212 integrally formed and extending over both core portions 110, 210 is referred as an integrated fin 300, and both core portions 110, 210 integrated by the integrated fin 300 is referred as an heat exchanging portion 330.

As shown in FIG. 3, the flat portions 112*c*, 212*c*, include louvers 112*d*, 212*d*, respectively, to disorder the air-flow passing through the fins 112, 212 for preventing thermal boundary layer from increasing. The louvers 112*d*, 212*d* are formed by etching a part of flat portions 112*c*, 212*c*. Further, as shown in FIG. 4, connecting portions 310 are partially provided between the flat portions 112*c* and 212*c* for partially connecting the condenser fin 112 to the radiator fin 212 while keeping the condenser fin 112 apart from the radiator fin 212 by a predetermined gap W.

Here, the predetermined gap W is at least larger than plate thickness of both fins 112, 212. A slit 320 is provided by keeping the condenser fin 112 apart from the radiator fin 212, and the slit 320 suppresses the heat transmission from the radiator core portion 210 to the condenser core portion 110.

Figure 3A:
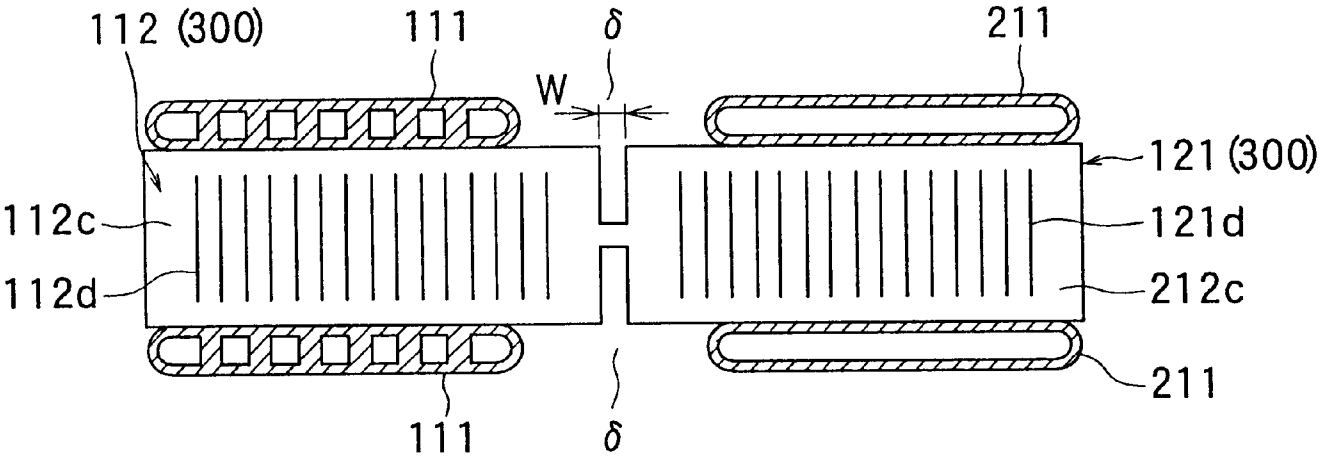
FIG. 3A is a cross-sectional view showing an upper area of a heat exchanging core portion with respect to line III—III in FIG. 1 (first embodiment)
Figure 3B:
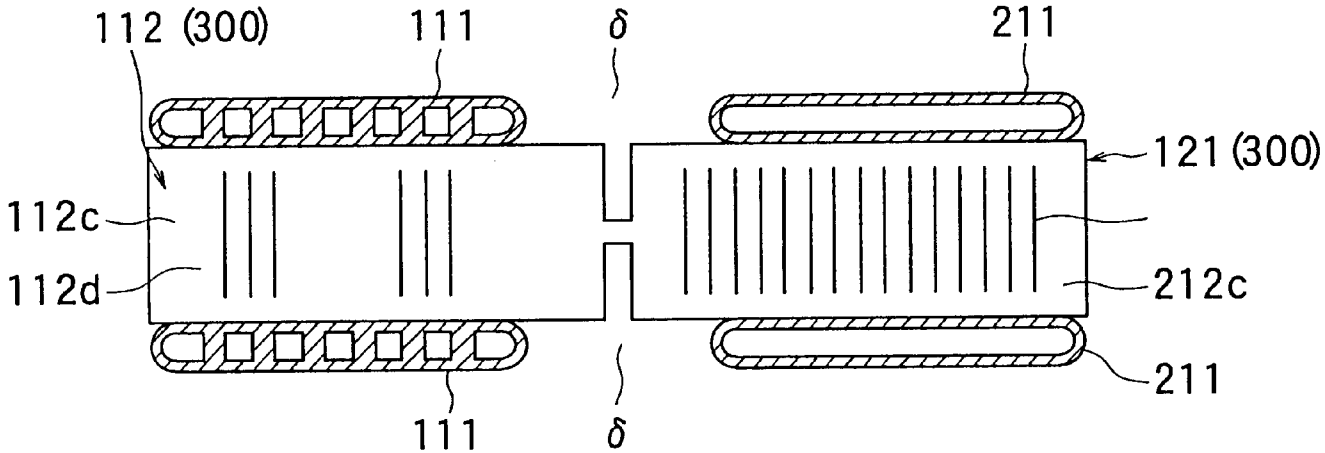
FIG. 3B is a cross-sectional view showing a lower area of the heat exchanging core portion with respect to line III—III in FIG. 1 (first embodiment)

In the integrated fin 300, arrangements and design of the louvers 112*d* and 212*d* are different between at an upper area and a lower area of one-dotted chain line III—III in FIG. 1. For example, as shown in FIG. 3A, at the upper area of the line III—III, the arrangements and design of the louvers 112*d* are the same as of the louvers 212*d*. That is, etching angle, etching length, width dimension, and the number of louvers 112*d* are the same as of the louvers 212*d*. At the lower area of the line III—III, as shown in FIG. 3B, the number of louvers 112*d* is smaller than that of louvers 212*d*, and remaining arrangements and design thereof are the same as of the louvers 212*d*.

As shown in FIGS. 1 and 2, a side plate 400 is provided at the bottom of both core portions 110, 210 for supporting both core portions 110, 210. The side plate 400 includes a bracket 410 for attaching the heat exchanger 500 to a vehicle.

A first radiator tank 220 is disposed at one end of the radiator core portion 210. The first radiator tank 220 distributes the engine coolant into each radiator tube 211. A second radiator tank 230 is disposed at the other end of the radiator core portion 210. The second radiator tank 230 receives the engine coolant having been heat-exchanged with the air.

The first radiator tank 220 includes an inlet port 221 at the upper area thereof. The engine coolant flowing out of the engine is introduced into the first radiator tank 220 through the inlet port 221. The second radiator tank 230 includes an outlet port 231 at the lower area thereof. The engine coolant flows out of the second radiator tank 230 through the outlet port 231, and flows to the engine.

A joint pipe 222, 232 is brazed to each radiator tank 220, 230 for connecting outside pipes (not illustrated) to each radiator tank 220, 230.

A first condenser tank 120 is disposed at one end of the condenser core portion 110. The first condenser tank 120 distributes the refrigerant into each condenser tube 111. A second condenser tank 130 is disposed at the other end of the condenser core portion 110. The second condenser tank 130 receives the refrigerant having heat-exchanged with the air.

The first condenser tank includes an inlet port 121 at the upper area thereof. The refrigerant discharged from a compressor (not illustrated) is introduced into the first condenser tank 120 through the inlet port 121. The second condenser tank 130 includes an outlet port 131 at the lower area thereof. The refrigerant having heat-exchanged with the air flows into an expansion valve (not illustrated) through the outlet port 131.

A joint pipe 122, 132 is brazed to each condenser tank 120, 130 for connecting outside pipes (not illustrated) to each condenser tank 120, 130.

Next, a method for manufacturing the integrated fin 300 will be explained.

Figure 5A:
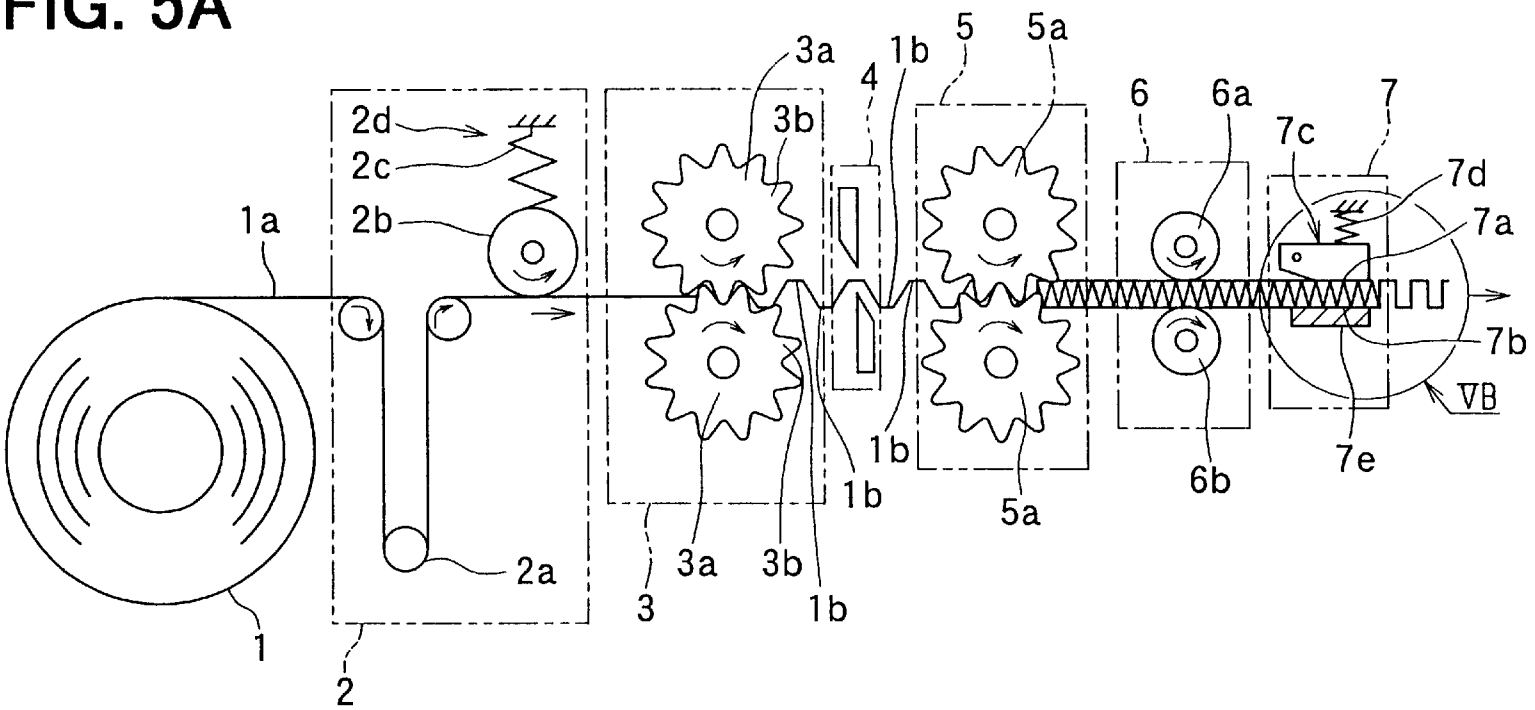
FIG. 5A is a schematic view showing a roller forming apparatus (first embodiment)
Figure 5B:
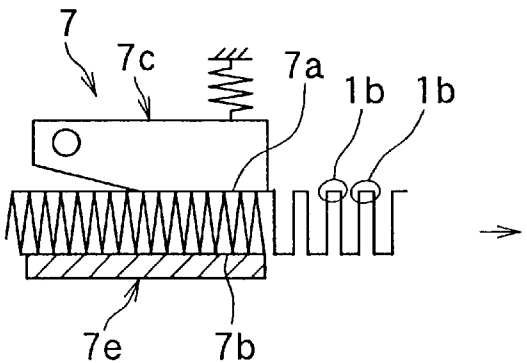
FIG. 5B is an enlarged view of V-portion in FIG. 5A (first embodiment)

FIG. 5 is a schematic view showing a roller-forming apparatus. As shown in FIG. 5, fin material 1*a* is rolled around a material roll 1. A tension apparatus 2 gives a predetermined tension force to the fin material 1*a* fed from the material roll 1. The tension apparatus 2 includes a weight tensioner 2*a*, and a roller tensioner 2*d* having a roller 2*b* and a spring 2*c*. The weight tensioner 2*a* gives a predetermined tension force to the fin material 1*a* due to gravity force. The roller 2*b* rotates along the proceeding of the fin material 1*a*. The spring 2*c* gives a predetermined tension force to the fin material 1*a* through the roller 2*b*.

Since the tension apparatus 2 gives a predetermined tension force to the fin material 1*a*, fin height h of the corrugate fin bending-formed by a fin forming apparatus 3 is constantly attained. Here, the fin height h is defined by a height difference between the peak 112*a*, 212*a* and the valley 112*b*, 212*b* adjacent thereto.

The fin forming apparatus 3 bends the fin material 1*a* to form a plurality of rectangular peaks 112*a*, 212*a* and rectangular valleys 112*b*, 212*b*. Hereinafter, the peak 112*a*, 212*a* and the valley 112*b*, 212*b* are referred as a bent potion 1*b*. Further, the fin forming apparatus 3 forms louvers 112*d*, 212*d* on the flat portions 112*c*, 212*c*.

The fin forming apparatus 3 includes a pair of gear-like forming rollers 3*a* having a cutter (not illustrated) on the tooth flank thereof. The cutter forms the louvers 112*d*, 212*d*. When the fin material 1*a* passes through the forming rollers 3*a*, the teeth of the forming roller 3*a* bends the fin material 1*a* to form the bent portion 1*b*, and the cutter forms the louvers 112*d*, 212*d* simultaneously.

A cutting apparatus 4 cuts the fin material 1*a* including the bent portions 1*b* and the louvers 112*d*, 212*d*. The fin material 1*a* is cut every predetermined length such that each corrugate fin has a predetermined number of bent portions 1*b*. A feeder 5 feeds the predetermined length fin material 1*a* toward a straightening apparatus 6.

The feeder 5 includes a pair of gear-like feeding rollers 5*a* having a standard pitch being substantially the same as a distance between the adjacent bent potions 1*b*.

When a fin pitch (distance between adjacent bent portions 1*b*) of the corrugate fin is designed small, pressure angle of the forming roller 3*a* is designed large, and when the fin pitch is designed large, the pressure angle is designed small. Here, a module difference between the forming roller 3*a* and the feeding roller 5*a* is within 10%, the corrugate fin is formed without changing the feeding roller 5*a*.

The straightening apparatus 6 presses the bent portion 1*b* from a direction perpendicular to a ridge direction of the bent portion 1*b* to remove concaves and convexes from the bent portion 1*b*. The straightening apparatus 6 includes a pair of straightening rollers 6*a*, 6*b* catching the fin material 1*a* therebetween. The straightening rollers 6*a*, 6*b* rotates in accordance with the proceeding of the fin material 1*a*. The straightening rollers 6*a*, 6*b* are arranged in such a manner that a line extending through the rotation centers of the straightening rollers 6*a*, 6*b* is perpendicular to the proceeding direction of the fin material 1*a*.

A brake apparatus 7 includes brake faces 7*a*, 7*b*. The brake faces 7*a*, 7*b* contact the plurality of bent portions 1*b* to generate friction force against the proceeding of the fin material 1*a*. The brake apparatus 7 is disposed at the proceeding forward side of the fin material 1*a* more than straightening apparatus 6. The brake apparatus 7 presses to gather the fin material 1*a* such that the bent portions 1*b* contact each other, by feeding force of the feeding apparatus 5 and friction force generated at the brake faces 7*a*, 7*b*.

A brake shoe 7*c* having the brake face 7*a* is rotatably supported at one end thereof, and a spring 7*d* is provided at the other end of the brake shoe 7*c*. The friction force generated at the brake faces 7*a*, 7*b* is adjusted by adjusting the deflection amount of the spring 7*d*. The brake shoe 7*c* and a plate 7*e* including the brake face 7*b* are made of die steel having good wear resistance.

An operation of the corrugate fin forming apparatus will be explained.

The fin material 1*a* is drawn from the material roll 1 (drawing process). The tension apparatus 2 gives the predetermined tension force to the fin material 1*a* in the proceeding direction of the fin material 1*a* (tensioning process). The fin forming apparatus 3 forms the bent portions 1*b* and the louvers of the fin material 1*a* (fin forming process). The cutting apparatus 4 cuts the fin material 1*a* every predetermined length.

Next, the feeding apparatus 5 feeds the predetermined length fin material 1*a* toward the straightening apparatus 6 (feeding process), and the straightening apparatus 6 presses the bent portions 1*b* to remove the concaves and convexes from the bent portions 1*b* (straightening process). After that, the brake apparatus 7 presses to gather the fin material 1*a* so that the adjacent bent portions 1*b* contact each other (gathering process).

After the gathering process, the fin material 1*a* expands, due to the resilient force thereof, to have a predetermined fin pitch, and after an inspection, the corrugate fin forming is completed.

Figure 6:
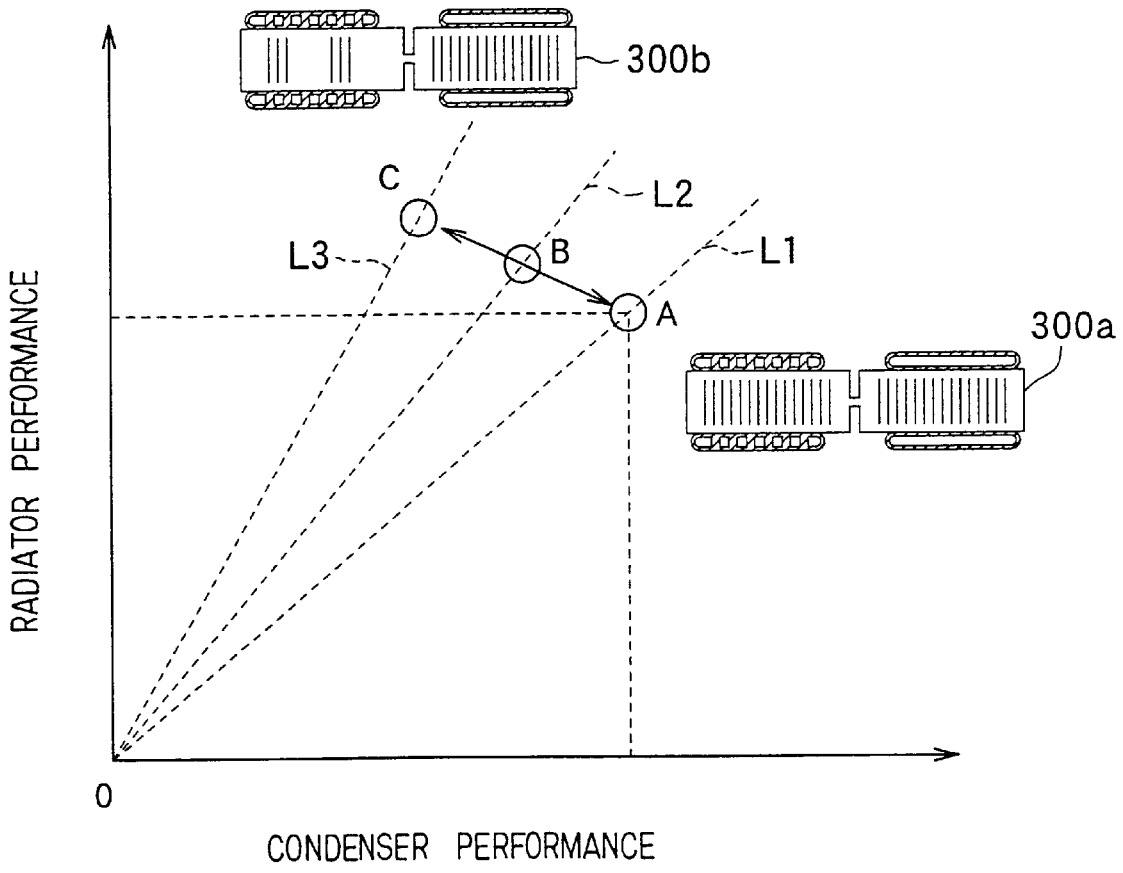
FIG. 6 is a graph showing heat exchanging performances of the condenser and the radiator in accordance with a ratio of integrated fins 300*a* to integrated fins 300*b* (first embodiment)

FIG. 6 is a graph showing heat exchanging performances of the condenser core portion 110 and the radiator core portion 210 in accordance with a ratio of the integrated fin 300 shown in FIG. 3A (hereinafter, referred as integrated fin 300*a*) to the integrated fin 300 shown in FIG. 3B (hereinafter, referred as integrated fin 300*b*). A linier line L1 extending through point A and point 0 denotes the heat exchanging performances when the integrated fin 300*a* is used for the entire heat exchanging portion 330.

While the ratio of the integrated fin 300*b* relative to the integrated fin 300*a* increases, linier line denoting the heat exchanging performances of the condenser core portion 110 and the radiator core portion 210 slides from L1 to L3 through L2. The linier line L3 denotes the heat exchanging performances when the integrated fin 300*b* is used for the entire heat exchanging portion 330.

As described above, according to the present embodiment, since the integrated fin 300*a*, 300*b* introducing different heat exchanging performances are appropriately arranged, required heat exchanging performance is easily attained with low cost.

Second Embodiment

In the second embodiment, a compound heat exchanger 700 is used for a hybrid car. The hybrid car includes an engine and an electric motor, and switches them to attain a driving source. The engine is mainly used to generate electric power for the motor, and the motor is mainly used for driving the hybrid car.

In the hybrid car, in addition to the engine, an electronic part such as an inverter controlling the motor has to be also cooled. For cooling the engine, the radiator has to be designed such that engine coolant temperature is less than 100–110° C. For cooling the electronic part, the radiator has to be designed such that electric part coolant is less than 60–70° C. which is lower than the engine coolant temperature.

In a vehicle having an automotive air conditioner, since the maximum refrigerant temperature is 80–90° C. which is lower than the engine coolant, the condenser for cooling the high-pressure refrigerant is disposed at air upstream side more than the radiator.

Figure 7:
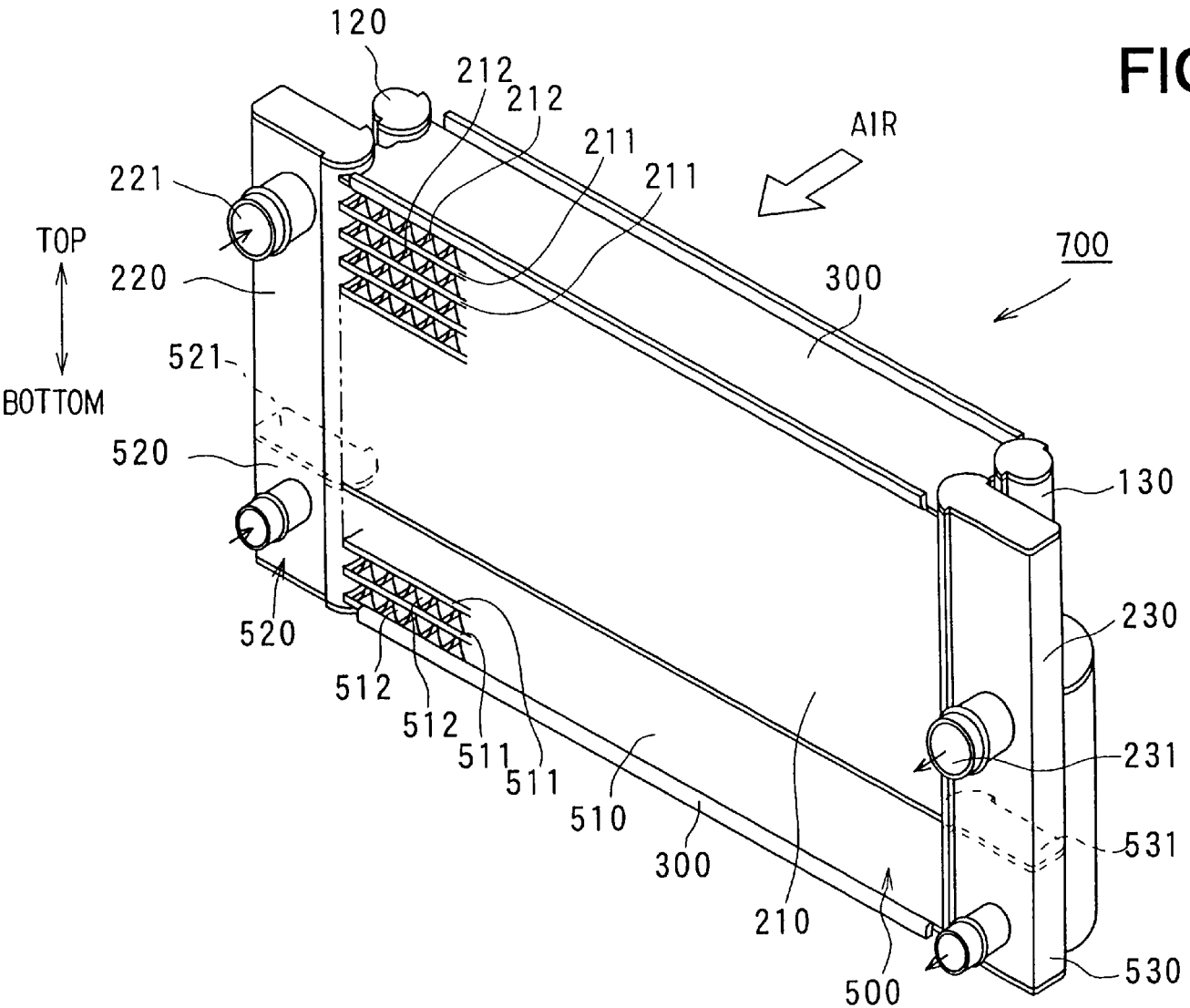
FIG. 7 is a perspective view showing a compound heat exchanger (second embodiment)

In the second embodiment, as shown in FIG. 7, a second radiator 500 for cooling the electric part is provided in addition to a first radiator 200 for cooling the engine coolant. The second radiator 500 has the same structure as the first radiator 200, and is integrated with the first radiator 200 by tanks.

As shown in FIG. 7, the second radiator 500 includes a second radiator core portion 510 where the electric part coolant is heat-exchanged with the air. The second radiator core portion 510 has a plurality of second radiator tubes 511 through which the electric part coolant flows, and a plurality of second radiator fins 512 provided between the adjacent second radiator tubes 511. A second radiator inlet tank 520 is disposed at one end of the second radiator tubes 511, and a second radiator outlet tank 530 is disposed at the other end of the second radiator tubes 511. The second radiator inlet tank 520 distributes the electric part coolant into each second radiator tube 511, and the second radiator outlet tank 530 receives the electric part coolant from each second radiator tube 511.

The first radiator inlet tank 220 and the second radiator inlet tank 520 are integrated within a cylindrical inlet tank having rectangular shape in cross section. Similarly, the first radiator outlet tank 230 and the second radiator outlet tank 530 are integrated within a cylindrical outlet tank having rectangular shape in cross section. Inside the inlet tank, a partition plate 521 partitions the second radiator inlet tank 520 from the first radiator inlet tank 220. Similarly, inside the outlet tank, a partition plate 531 partitions the second radiator outlet tank 530 from the first radiator outlet tank 230.

In this way, the first radiator core 210 and the second radiator core 510 are disposed in parallel with the air flow direction, and the condenser core 110 is disposed at the air upstream side of both radiator cores 210, 510 in series therewith.

Figure 8:
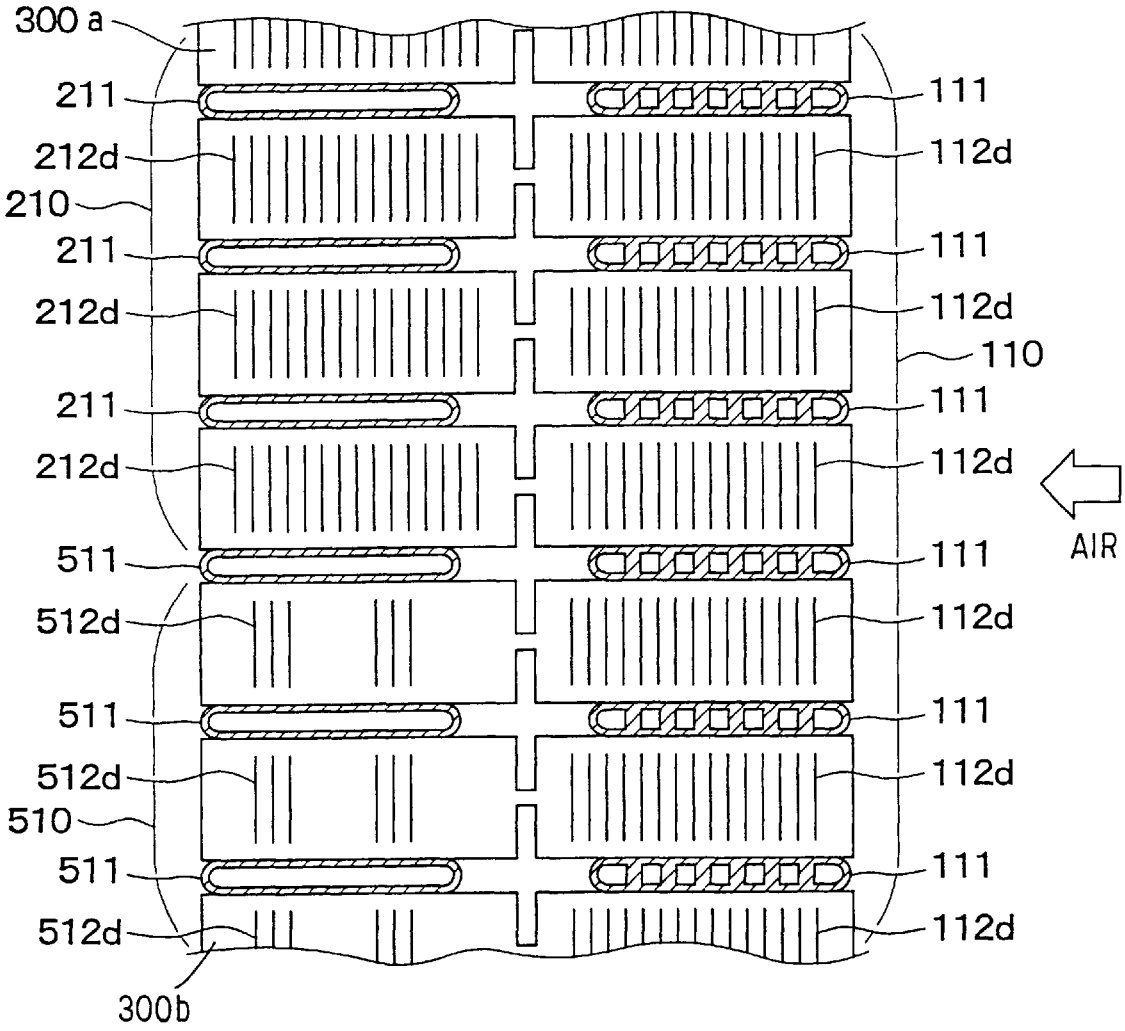
FIG. 8 is a cross-sectional view showing a heat exchanging core portion (second embodiment)

The integrated fin 300, as shown in FIG. 8, is connected to the outer surface of the tubes 111, 211, and 511 for promoting the heat exchanging performance, and extends over the tubes 111 and 211, and the tubes 111 and 511. According to an example shown in FIG. 8, the number of the louvers 212*d* and 512*d* are different between in the first radiator 200 and the second radiator 500. That is, the integrated fin 300*a* is used for the first radiator 200, and the integrated fin 300*b* is used for the second radiator 500.

Figure 9:
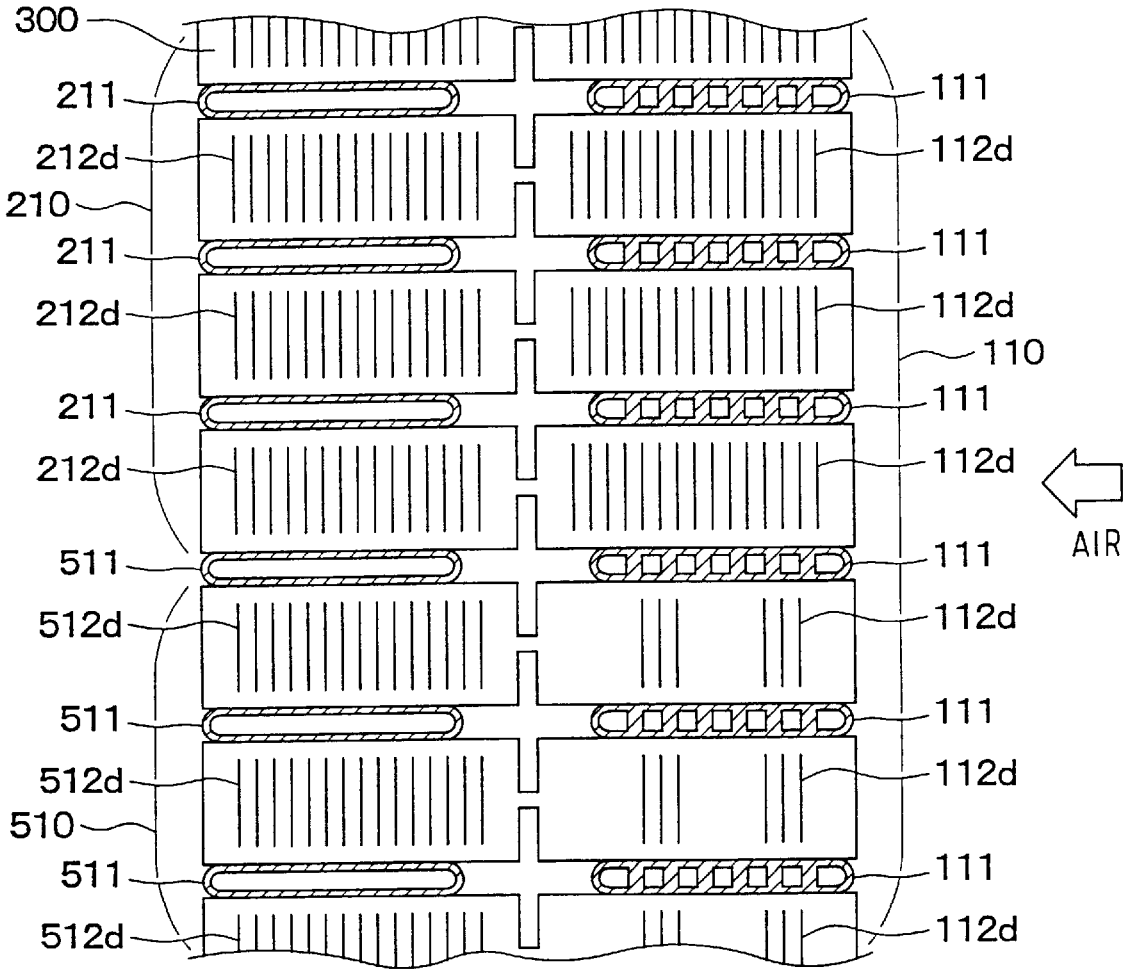
FIG. 9 is a cross-sectional view showing a heat exchanging core portion (second embodiment).

Here, alternatively, as shown in FIG. 9, the number of louvers may be different within the condenser core 110.

Modifications

According to the above-described embodiments, the number of louvers is different within the heat exchanging portion 330. Alternatively, etching angle of the louver, etching length of the louver, fin pitch P of the louver may be different between at one area and another area within the heat exchanging core portion 330.

According to the above-described embodiments, the roller forming apparatus produces the integrated fin 300. Alternatively, a pressing apparatus or the like may produce the integrated fin.

According to the above-described embodiments, the compound heat exchanger is used for the cooling module including the condenser and the radiator. Alternatively, the double heat exchanger may be used for other heat exchangers.

According to the above-described embodiments, arrangements of louvers are different between at the upper area and the lower area with respect to the line III—III in FIG. 1. Alternatively, arrangements of the louvers may be different between at right area and left area in FIG. 1, or the louvers 300*a* and 300*b* may be alternately arranged.

What is claimed is:

1. A heat exchanger comprising:

a first core portion to carry out a heat exchange between a first fluid and an external fluid, said first core portion including a plurality of first tubes through which the first fluid flows and first cooling fins disposed between said each pair of adjacent first tubes; and a second core portion disposed in series with said first core portion in an external fluid flow direction with a predetermined clearance therebetween, to carry out a heat exchange between a second fluid and the external fluid, said second core portion including a plurality of second tubes through which the second fluid flows and second cooling fins disposed between said each pair of adjacent second tubes, wherein each of said first cooling fins and said second cooling fins is integrated by a connecting portion, and one of said first cooling fins and said second cooling fins introduce different cooling performances between a first area and a second area within a respective one of said first core portion and said second core portion.

2. A heat exchanger according to claim 1, wherein said first cooling fins and said second cooling fins include a plurality of louvers, respectively, and arrangements of said louvers within said one of said first cooling fins and said second cooling fins are different between said first area and said second area of said respective one of said first core portion and said second core portion.

3. A heat exchanger according to claim 2, wherein the number of said louvers within said one of said first cooling fins and said second cooling fins are different between said first area and said second area of said respective one of said first core portion and said second core portion.

4. A heat exchanger according to claim 1, wherein said first and second cooling fins are formed by a roller forming apparatus for continuously forming a plate material into a predetermined shape while rotating.

5. A compound heat exchanger including a refrigerant condenser and an engine coolant radiator, comprising:

a condenser core portion to carry out a heat exchange between a refrigerant and air, said condenser core portion including a plurality of condenser tubes through which the refrigerant flows and condenser fins disposed between said each pair of adjacent condenser tubes; and a radiator core portion disposed in series with said condenser core portion in an air flow direction with a predetermined clearance therebetween, to carry out a heat exchange between an engine coolant and the air, said radiator core portion including a plurality of radiator tubes through which the engine coolant flows and radiator fins disposed between said each pair of adjacent radiator tubes; wherein each of said condenser fins and said radiator fins are integrated by a connecting portion, and one of said condenser fins and said radiator fins introduce different cooling performances between a first area and a second area within a respective one of said condenser core portion and said radiator core portion.

6. A compound heat exchanger according to claim 5, wherein said condenser fins and said radiator fins include a plurality of louvers, respectively, and arrangements of said louvers within said one of said condenser fins and said radiator fins are different between said first area and said second area said respective one of said condenser core portion and said radiator core portion.

7. A compound heat exchanger according to claim 6, wherein the number of said louvers within said one of said condenser fins and said radiator fins are different between said first area and said second area of said respective one of said condenser core portion and said radiator core portion.

8. A compound heat exchanger according to claim 5, wherein said radiator core portion includes a first radiator core portion and a second radiator core portion, said first radiator core portion includes a plurality of first radiator tubes through which the engine coolant flows and first radiator fins disposed between said each pair of adjacent first radiator tubes;

said second radiator core portion includes a plurality of second radiator tubes through which an electronic part coolant flows and second radiator fins disposed between said each pair of adjacent second radiator tubes, and said first radiator fins and said second radiator fins introduce cooling performances different from each other.

9. A compound heat exchanger according to claim 8, wherein said first radiator fins introduce cooling performance is more than said second radiator fins.

10. A heat exchanger comprising:

a heat exchanging core portion including:

a first core portion to carry out a heat exchange between a first fluid and an external fluid, said first core portion including a plurality of first tubes through which the first fluid flows and first cooling fins disposed between said each pair of adjacent first tubes;

a second core portion disposed in series with said first core portion in an external fluid flow direction with a predetermined clearance therebetween, to carry out a heat exchange between a second fluid and the external fluid, said second core portion including a plurality of second tubes through which the second fluid flows and second cooling fins disposed between said each pair of adjacent second tubes; and a third core portion disposed in series with said first core portion in the external fluid flow direction with a predetermined clearance therebetween, and disposed in parallel with said second core portion in the external fluid flow direction to carry out a heat exchange between a third fluid and the external fluid, said third core portion including a plurality of third tubes through which the third fluid flows and third cooling fins disposed between said each pair of adjacent third tubes, wherein each of some first cooling fins and said second cooling fins is integrated by a connecting portion, each of remaining first cooling fins and said third cooling fins is integrated by a connecting portion, and said first cooling fins, said second cooling fins and said third cooling fins introduce different cooling performances between one area and another area within said heat exchanging core portion.

11. A heat exchanger according to claim 10, wherein said second cooling fins and said third cooling fins introduce different cooling performances from each other.

12. A heat exchanger according to claim 10, wherein said first cooling fins introduce different cooling performances between at one area and another area within said first core portion.

13. A heat exchanger comprising:

a core portion to carry out heat exchange between an internal fluid and an external fluid, said core portion including a first plurality of tubes through which the first fluid flows and a first plurality of cooling fins disposed between said each pair of adjacent first tubes, wherein said first cooling fins are arranged to achieve a first cooling performance; and a second plurality of tubes through which the first fluid flows and a second plurality of cooling fins disposed between each pair of adjacent second tubes, wherein said second plurality of cooling fins are arranged to achieve a second cooling performance, wherein said second cooling performance is different from said first cooling performance.

* * * * *